US006695533B1

(12) United States Patent
Bulmann

(10) Patent No.: US 6,695,533 B1
(45) Date of Patent: Feb. 24, 2004

(54) BOAT HOIST HYDRAULIC LIFT DEVICE

(76) Inventor: Stephen P. Bulmann, 2030 US 131 S., Boyne Falls, MI (US) 49713

( * ) Notice: Subject to any disclaimer, the term of this patent is extended or adjusted under 35 U.S.C. 154(b) by 0 days.

(21) Appl. No.: 10/361,302

(22) Filed: Feb. 10, 2003

Related U.S. Application Data

(60) Provisional application No. 60/355,734, filed on Feb. 8, 2002.

(51) Int. Cl.[7] ..... B63C 3/06

(52) U.S. Cl. ..... 405/3; 114/44

(58) Field of Search ..... 405/1, 3, 7; 114/44, 114/45, 48; 414/495, 496, 545

(56) References Cited

U.S. PATENT DOCUMENTS

| | | | | |
|---|---|---|---|---|
| 3,275,170 A | | 9/1966 | MacRae et al. | 414/545 |
| 3,452,892 A | | 7/1969 | Modenesi | 414/460 |
| 3,593,824 A | | 7/1971 | Gregory | 254/386 |
| 4,236,859 A | | 12/1980 | Stearn et al. | 414/460 |
| 4,540,329 A | | 9/1985 | Martin | 414/545 |
| 4,641,596 A | | 2/1987 | Reprogle et al. | 114/44 |
| 4,773,346 A | | 9/1988 | Blanding et al. | 114/45 |
| 5,090,841 A | | 2/1992 | Penick, Jr. et al. | 405/3 |
| 5,522,671 A | | 6/1996 | Keesling | 405/3 |
| 5,692,857 A | | 12/1997 | Ness | 405/3 |
| 5,772,360 A | * | 6/1998 | Wood, II | 405/3 |
| 5,888,019 A | * | 3/1999 | Quastad | 405/3 |
| 5,934,826 A | | 8/1999 | Mansfield | 405/3 |
| 6,045,317 A | | 4/2000 | Boucher et al. | 414/495 |
| 6,076,478 A | * | 6/2000 | Siegmann | 114/45 |
| 6,230,639 B1 | * | 5/2001 | McLaughlin et al. | 114/44 |
| 6,554,533 B2 | * | 4/2003 | Godbersen | 405/3 |

* cited by examiner

*Primary Examiner*—Thomas B. Will
*Assistant Examiner*—Tara L. Mayo
(74) *Attorney, Agent, or Firm*—Douglas S. Bishop

(57) ABSTRACT

A hydraulic lift device for in-water boat hoists. A hydraulic cylinder is utilized to extend and retract a cylindrical rod with a vertical cross member at its end. Lift cables are attached to the cross member on opposite sides and extend rearwardly toward the hydraulic cylinder. One cable is horizontally reversed, 180° by a pulley, with both cables then directed 90° downward over respective pulleys and affixed to opposite ends of the cradle of the hoist, equalizing end to end lift. Side to side lift may be equalized by a second parallel device or by levelings cables. Primary components are contained within an attached enclosure, above water level. Remote operation and solar power may be provided.

18 Claims, 7 Drawing Sheets

BOAT HOIST HYDRAULIC LIFT DEVICE

THIS APPLICATION CLAIMS BENEFIT OF U.S. PROVISIONAL APPLICATION SERIAL NO. 60/355,734 FILED FEB. 2, 2002.

BACKGROUND OF INVENTION

This invention relates to boat hoists, generally, and, more specifically, to a hydraulic lift device for a boat hoist, in which the structure to which the principal components thereof are attached also provides a protective enclosure for those components.

A variety of prior art applications are known related to the function of vertically moving a suspended boat cradle by various means including some hydraulic applications. Such hoists are used in residential, recreational and light commercial settings, to lift a boat out of the water when not in use. In northern locales, these hoists must also be seasonably removable to prevent ice damage of hoist components at or below the water surface.

Prior art applications in the field have included variations of cantilever-style hoists. Many of these employ hydraulic cylinders below the water surface. Some hoists of this type have utilized large winches forward of the hoist to pull the hoist's bed or cradle over its pivot point. There has been limited success, as well, with vertical lifts which utilize hydraulics or large cable winches.

Existing vertical winch lifts, typically may be outfitted with two or more winches, particulary for heavier weight applications, and these multiple winches may run at varying speeds, which may be disadvantageous.

Hydraulic vertical lifts of the existing art often use one cable to lift one corner of the lifting bed or cradle, using multiple leveling cable to equalize lift on all other corners. Existing hydraulic applications, as well, utilize the "pull" of the hydraulic cylinder, rather than the "push". Because of these factors most existing hydraulic lifting devices have significant load limitations.

Hydraulic cantilever lifts require substantial structure support because of compounded force at bottom of the lifting cycle. Significantly more power is required in the initial portion of the cycle than in the latter. It is also typical of the prior art that the hydraulics are beneath the water surface when the hoist is operated. This creates a number of disadvantages.

Below surface hydraulics are not only difficult to service, but are exposed to harsh elements, including sand, salt (in salt water applications), zebra muscles and barnacles. Below lift mechanical components will also require deeper water, which is a luxury not always available, because the lift bed may not be able to be placed as proximate to the bottom as is optimally desired. Because of their method of operation, and upper configuration, hydraulic cantilever hoists may also be difficult to accessorize with such important additions as canopies and motor and bow stops.

Winch cantilever hoists address some concerns, but present their own problems. Structure size and weight, to address strength requirements, limit mobility of the entire hoist assembly. They are also generally powered by 220 volt electricity which is potentially hazardous in a marine environment.

Representative of the prior art are U.S. Pat. No. 5,934,826 to Mansfield disclosing a combination boat lift apparatus and piling; U.S. Pat. No. 5,522, 671, to Keesling, disclosing a pair of hydraulic cylinders vertically mounted in conjunction with reinforced concrete pilings; U.S. Pat. No. 5,090, 841, to Pench, Jr. et al, disclosing a hydraulic pump and cylinder on a manual boat lift; U.S. Pat. No. 4,773,346 to Blanding et al., disclosing vertically mounted hydraulic cylinders, at each corner of a boat hoist; and U.S. Pat. No. 4,641,596 to Reprogle et al., which discloses a combination of vertical hydraulic cylinders and moveable pulley blocks;

Accordingly, a need exists for a boat hoist hydraulic lift device which may be used in conjunction with an easily portable boat hoist to maximize mobility; which allows the lift bed of the hoist to rest as proximate to the bottom of the body of water as possible; which utilizes the "push" as opposed to the "pull" of the hydraulic cylinder unit; which does not require 220 volt electrical power from an external source; which provides equal vertical "lift" directly to both ends of the lift bed; and which is constructed so that the primary mechanical and power components are located above the surface of the water and are otherwise shielded from the elements.

The present invention is so directed.

SUMMARY OF THE INVENTION

The present invention has been designed to the overcome the shortcomings in the prior art as noted above. It is directed to the provision of a significantly improved lifting device for utilization with in-water boat hoists.

More specifically, this invention is directed to a boat hoist hydraulic lift device which may be used in conjunction with currently existing boat hoist frames to provide a portable boat hoist which maximizes mobility.

An additional object of the invention is to provide a boat hoist hydraulic lift device which allows the lift bed of the hoist to rest as approximate as possible to the bottom of the body of water and, further is constructed so that the primary mechanical components are located above the surface of the water, and are shielded from other elements as well.

An additional object of the invention is to provide a hydraulic lift device which maximizes lifting power by utilizing the "push" of a hydraulic cylinder, as opposed to the "pull" thereof. Further, the device is directed to provision of a hydraulic lifting function in an in-water boat hoist application which does not require 220 volt electrical power from an external source and which provides equal vertical lift directly to both ends of the lift bed.

The boat hoist lift device which is a primary object of the invention is utilized in conjunction with in-water boat hoists having a base frame, which is normally adjustable, to rest substantially horizontally on the bottom of a body of water. Such hoists are normally substantially rectangular in shape, with a lower rectangular base, and supporting shoes or skids, which have an adjustment means to level the lower portion of the hoist. The hoist itself has a plurality of stanchions which extend vertically, normally at the corners thereof, and along the sides. Stanchions are not normally provided along the ends of the hoist, as that is where the boat, or other load to be lifted, normally enters and exits.

In conjunction with the type of hoist described, the present invention, in an important feature, may utilize either one hydraulic lift device or a pair of such devices mounted in parallel, on opposite sides of the boat hoist.

According to a further important feature of the invention, each individual hydraulic lift device unit initially includes a support and enclosure unit, extending between upright stanchions of the boat hoist assembly itself, on one side of the boat hoist. This rigid unit provides the dual function of supporting the hydraulic lift device and its primary components, and further, enclosing those components and shielding them from the elements. This rigid support member is essentially a rigid, longitudinal box member, extending between upright boat hoist stanchions and includes joined and enclosed bottom, back, top, and end units. A front cover unit, which is removable, is also provided, for access to the components for service and maintenance.

According to a further feature of the invention, within the support structure enclosure, a hydraulic cylinder, which includes a cylinder body and extendable piston, is secured, in horizontal relationship. The cylinder body itself is located more closely to one end of the enclosure, and the piston rod is extended by hydraulic pressure, outwardly, toward the other end of the enclosure.

A further feature of the invention includes a vertical yoke member which is centered on and attached, by clevis, or other means, to the end of the piston rod. Two separate lift cables extend rearwardly, substantially in parallel, from the yoke at the end of the piston rod, towards the end of the enclosure where the cylinder body is located. One of the lift cables continues such horizontal extension to a point closely approximate to the end of the support enclosure member, where it is directed downwardly, at approximately a 90° angle, over a fixed pulley. The other lift cable extends in the same initial direction, until it reaches a pulley affixed within the enclosure at, or beyond the point where the piston rod enters and exits the cylinder body. The cable is reversed on the pulley, and extends, in substantially a 180° reversal, to another pulley located approximate to the opposing end of the support enclosure member. At that point it is directed downward approximately 90° over another fixed pulley. Both cables extend through openings provided in the base of the support enclosure member substantially vertically downward and are connected, respectively, at opposite ends, thereof, to the lift bed.

It is a further feature of the invention that the extension of the piston rod from the hydraulic cylinder, for a specified distance, occasions a rise in the lift bed of the boat hoist of an equivalent distance.

Another important feature of the invention limits rotational movement of the yoke at the end of the piston rod, and limits upward or downward movement, as well, thus minimizing wear on the hydraulic cylinder, at the point where the rod enters and exits. It is a feature of the invention, that this is accomplished by utilization of two tracks, which may be extruded ridges, a separate "C-channel" member in parallel with the piston rod, or other upper and lower track means, which contact the yoke at the end of the piston rod in a manner which allows it to slide back and forth horizontally, but which do not allow rotational, or vertical movement.

It is another feature of the invention, that, when a single hydraulic lift device is utilized on one side of a boat hoist assembly, with lift cables affixed to each end of the lift bed, of the hoist assembly, that the lift bed may be maintained in a substantially horizontal position, by utilization of one or more leveling cables. Each leveling cable is affixed to the upper end of a vertical stanchion, on the side of the boat lift opposite the location of the support enclosure member and primary components. The leveling cable runs substantially vertically down to the lift bed, where it contacts a pulley and is guided, directionally, approximately horizontally, along one end of the lift bed to the opposite side thereof, where it contacts another pulley and is thereby directed approximately 90° downwardly, where the cable is affixed to the base of the boat hoist either on the end of vertical stanchion or approximate thereto. The leveling cables may be used on either or both ends of the hoist assembly, and are optimally used on both. When one hydraulic lift device is utilized, with leveling cables at both ends, each leveling cable commences by attachment at the top of the end stanchion on the opposite side of the lift from the device, and runs, as stated, to the lower corner of the hoist assembly on the side where the hydraulic device is located.

According to a further feature of the invention, when a pair of hydraulic lift devices are utilized in parallel on opposite sides of the boat hoist assembly, the leveling cable at one end of the boat lift will commence affixed to the top of an end stanchion on one side of the boat lift, and the other end leveling cable will commence at the top of a stanchion on the opposing side of the hoist.

The leveling cables are installed and maintained under static tension.

It is a further feature of the invention that a power source for operating one or both hydraulic cylinders is self contained within the enclosure member and the hydraulic cylinder, either singly, or in parallel when two are provided, and may be activated by means of a self-contained on/off switch and, in some applications such on/off switch or function may be accomplished by utilization of radio frequency receiver unit located adjacent one of the cylinder bodies, within the enclosure member and a remote radio frequency sender unit.

A further feature of the invention, is that the self-contained power source may be a 12 volt battery affixed within the support enclosure member and, as a further feature of the invention the power source may be replenished by means of a rigid solar panel connected thereto, and outwardly affixed on the exterior of the hoist assembly. It is a further feature of the invention that where a pair of hydraulic lift devices are utilized in parallel, a single power source and common means of activating the hydraulic cylinders may be utilized.

The above and additional features of the invention may be considered and will become apparent upon review of the drawings in particular and the detailed description which follows.

BRIEF DESCRIPTION OF THE DRAWINGS

The following detailed description is best understood by reference to the following drawings, in which.

DETAILED DESCRIPTION OF THE PREFERRED EMBODIMENT

Figure 1:
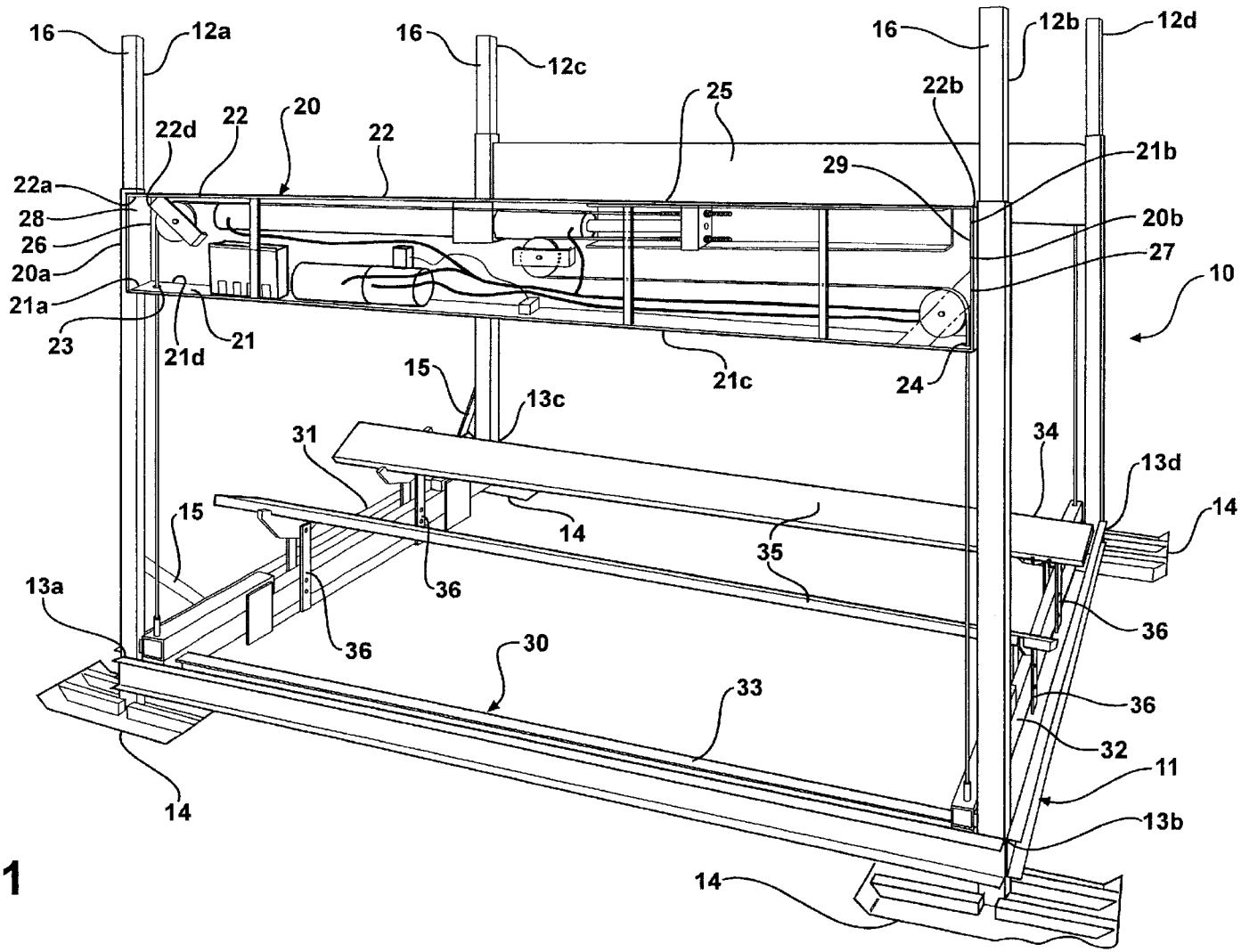
FIG. 1 is a side perspective view of a boat hoist having a pair of parallel mounted lift devices with the cover of the forward device removed.
Figure 2:
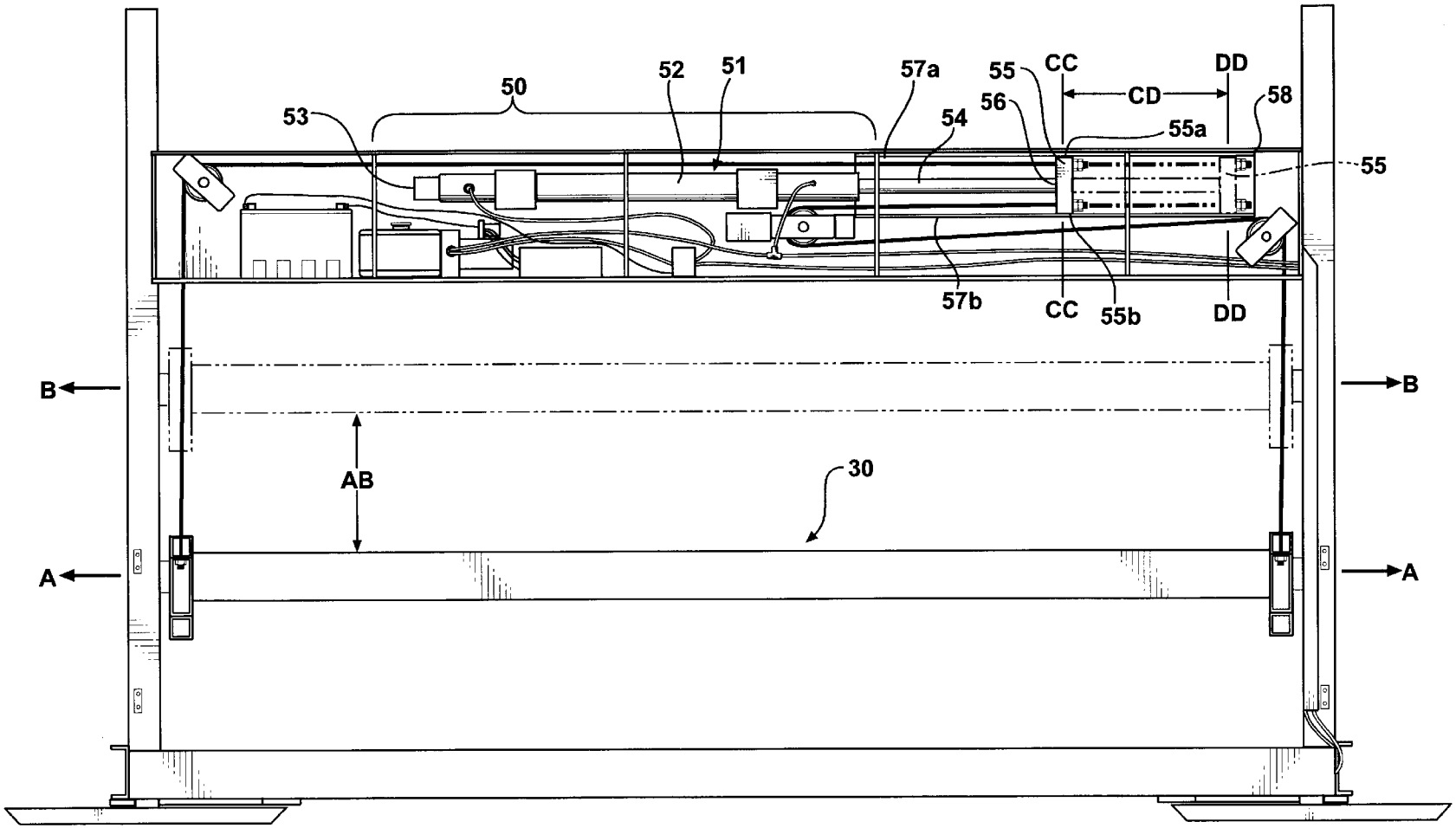
FIG. 2 is a side view of the device as shown in FIG. 1, showing extension of the piston rod and the raised position of the lift bed coincident to such extension.
Figure 3:
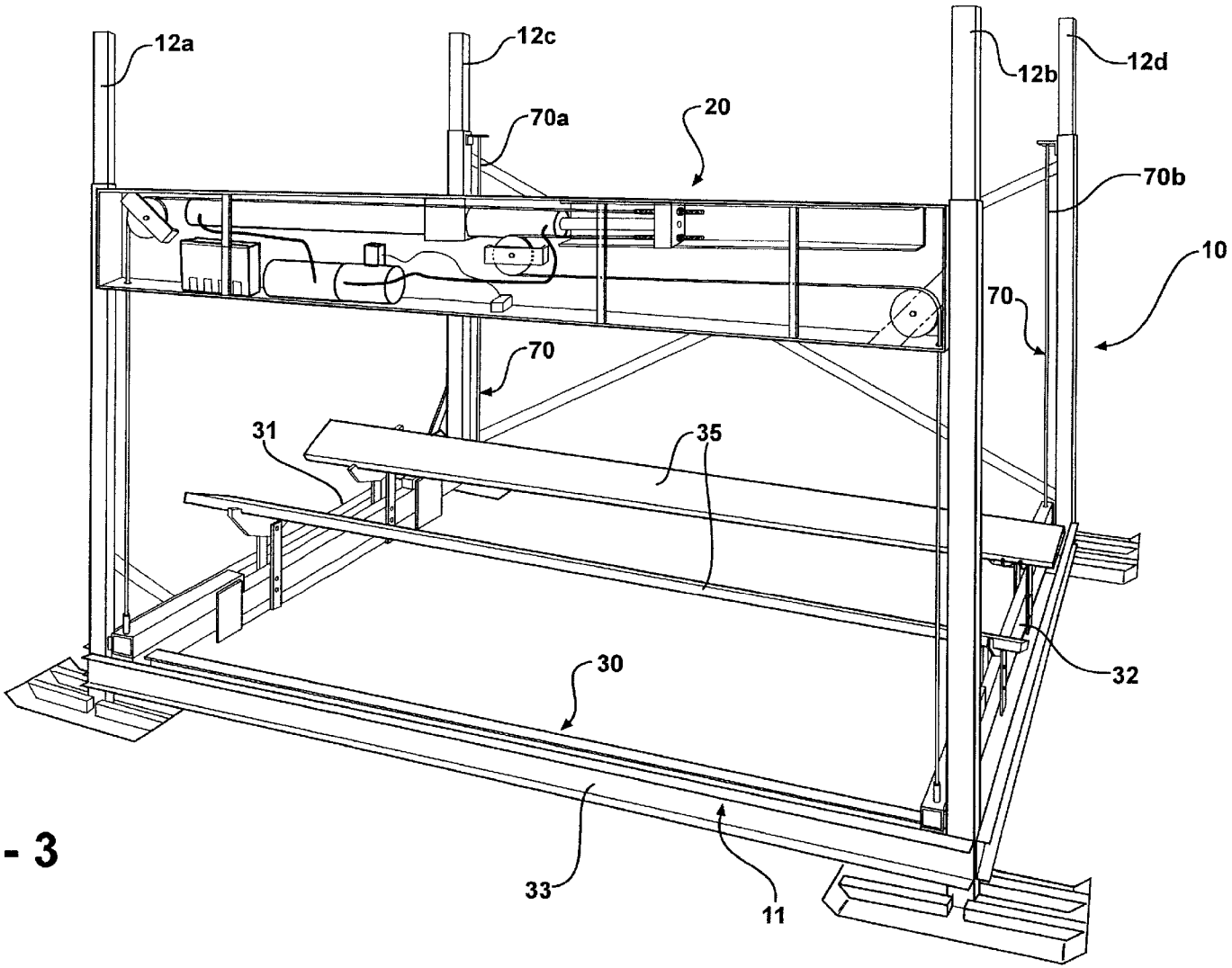
FIG. 3 is a side perspective view of a boat hoist having a single lift device, with the cover panel removed to expase the components thereof, and further demonstrating the inclusion of leveling cables.
Figure 4:
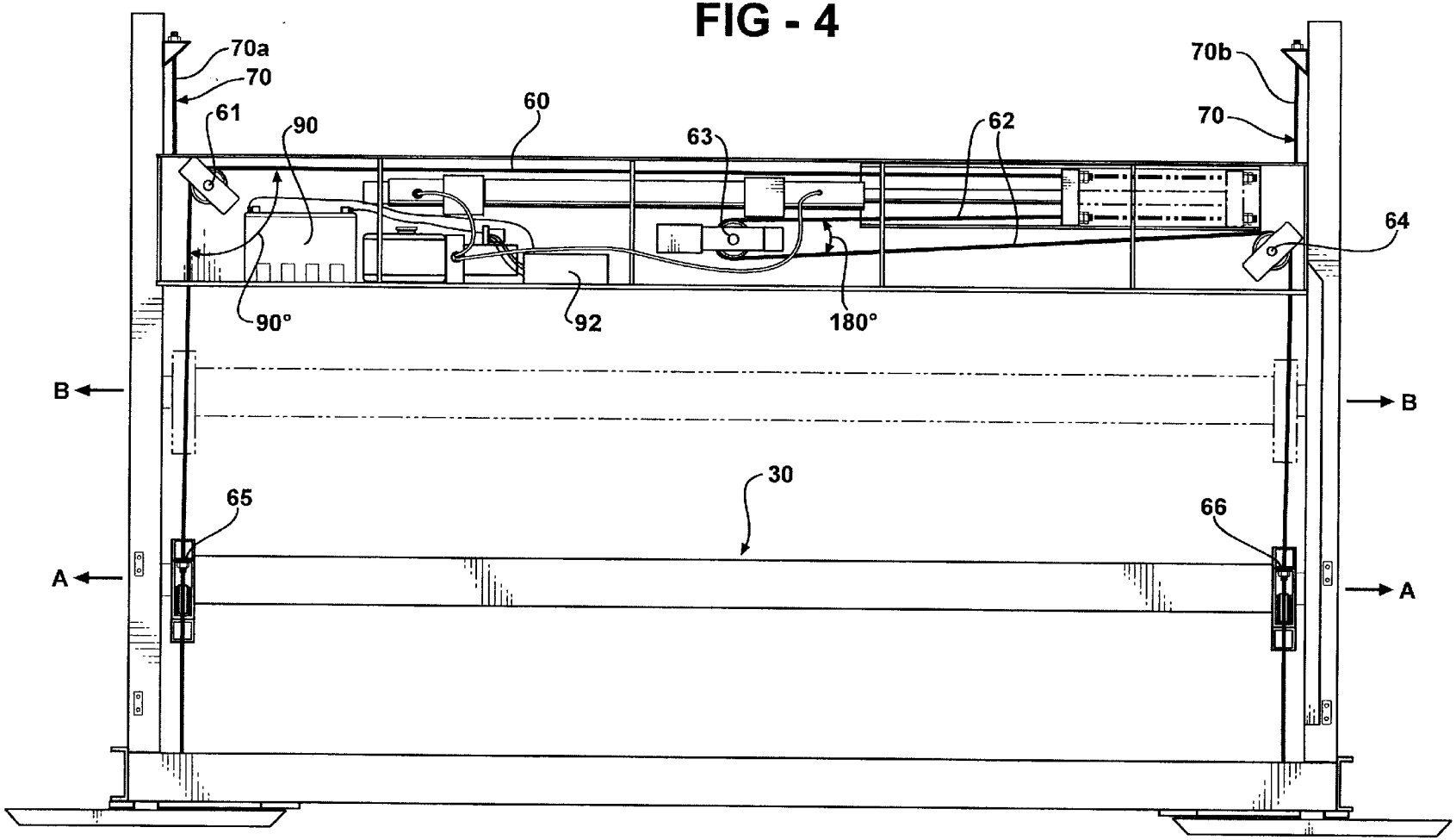
FIG. 4 is a side view of the device shown in FIG. 3, showing extension of the piston rod from the hydraulic cylinder and the corresponding elevation of the lift bed coincident thereto.
Figure 5:
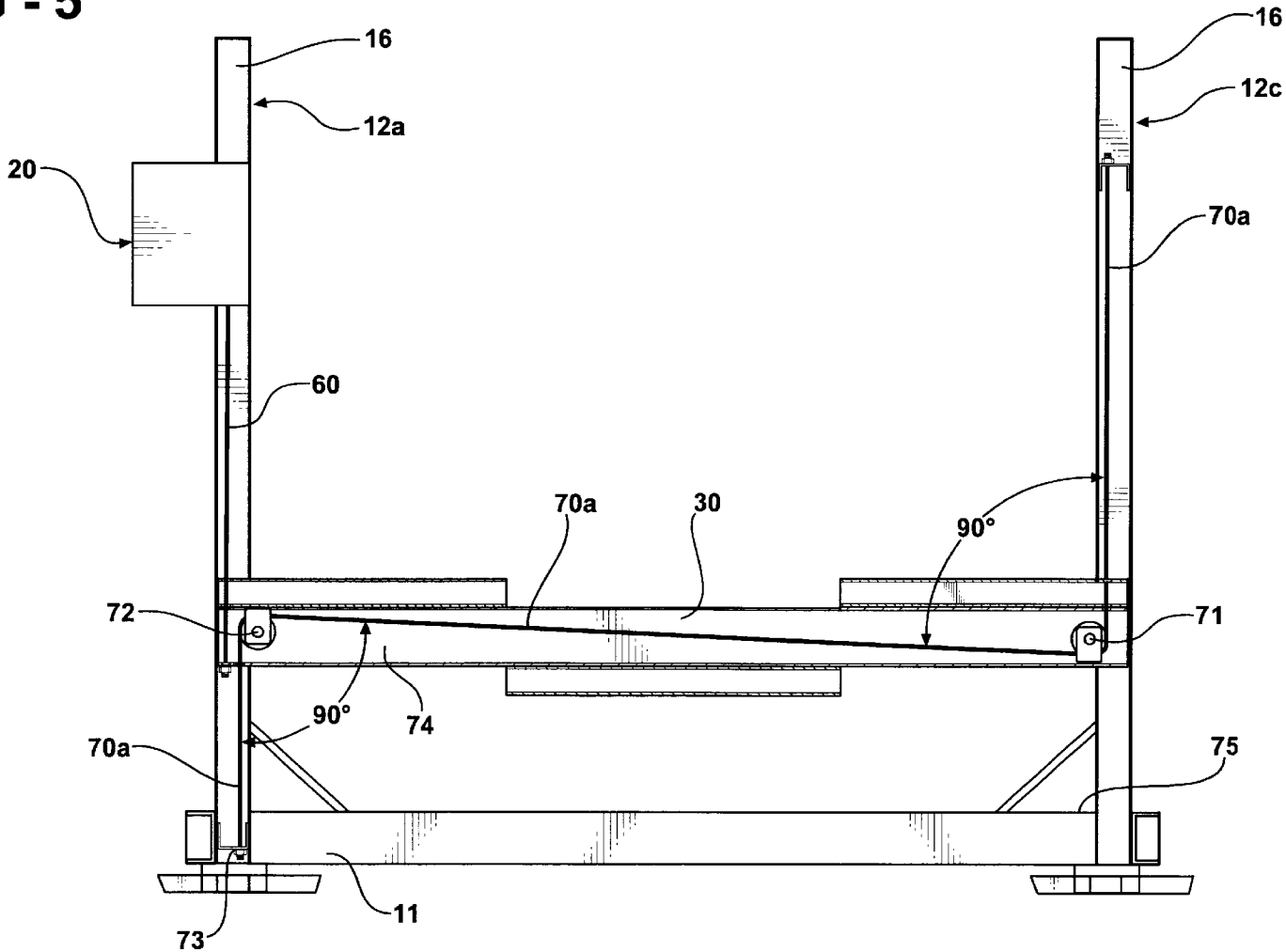
FIG. 5 is a cross-sectional view of a forward or first end of a boat hoist having one hydraulic device, showing the relative relationship of the device, the lift bed, and a leveling cable.
Figure 6:
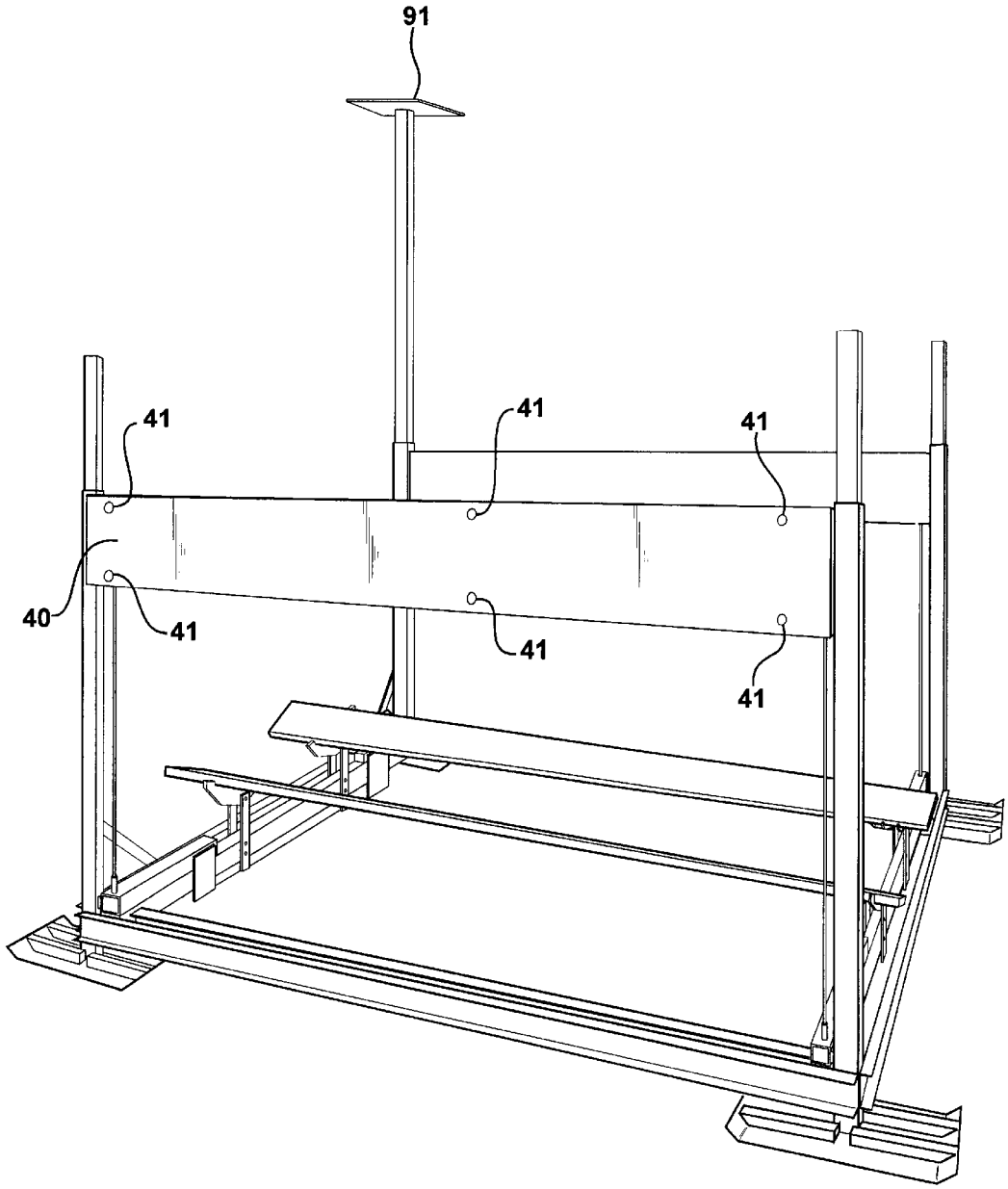
FIG. 6 is a perspective view a boat hoist employing two hydraulic lift devices in parallel, with a rigid solar panel.

The invention boat hoist hydraulic lift device, broadly considered, includes a boat hoist assembly 10 and a rigid support enclosure 20, which as stated below, may be provided singly as shown in FIGS. 3, 4 and 5, or in tandem as shown in FIGS. 1, 2 and 6, and in either case, permanently fastened to the hoist assembly 10. A lift bed or deck 30 is also provided.

The hoist assembly 10 includes a generally rectangular rigid base frame 11. In the preferred embodiment four vertical stanchions 12*a*, 12*b*, 12*c* and 12*d*, extend upwardly from the four corners 13*a*, 13*b*, 13*c* and 13*d* of base frame 11. The base frame 11 is supported by skids 14 located below corners 12*a*, 12*b*, 12*c* and 12*d*. Struts 15 may be provided at angles between the base frame 11 and one or more of stanchions 12*a*, 12*b*, 12*c* and 12*d* to provide additional support.

In the preferred embodiment the rigid support enclosure 20 is a rigid box having a first end 20*a* and a second end 20*b*. Enclosure 20 has a horizontal flat base panel 21 and a corresponding parallel flat top panel 22. Base panel 21 has a first end edge 21*a*, a corresponding with first end 20*a*, a second end edge 21*b* corresponding with second end 20*b*, a forward edge 21*c* and rearward edge 21*d*. Top panel 22 has a corresponding first end edge 22*a*, second end edge 22*b*, forward edge 22*c* and rearward edge 22*d*.

Base panel 21 has two openings 23, located near first end 20*a*, and 24, located near second end 20*b*.

A back panel 25 is also provided running between and connecting rearward edge 21*d* of base panel 21 and rearward edge 22*d* of top panel 22, between first edges 21*a* and 22*a* and second edges 21*b* and 22*b*, forming a unitary first end edge 26 and a unitary second end edge 27. There is a first end panel 28 and second end panel 29 extending across and affixed, respectively, to first end edge 26 and second end edge 27. The joining of base panel 21, top panel 22, back panel 25, first end panel 28, and second end panel 29 forms rigid support enclosure member 20.

Rigid support enclosure 20 is rigidly affixed between the upper portions 16 of stanchions 12*a* and 12*b*.

In the preferred embodiment of the invention, a front panel or cover 40 is provided. Front panel 40 opposes back panel member 25. Panel 40 contacts the forward 40 edges 21*c* and 22*c* of base panel 21 and top panel 22 respectively and is removably held in place by a plurality of fasteners 41, which in the preferred embodiment may be threaded screws or bolts.

When the front panel or cover 40 is in place the interior of support enclosure member 20 is effectively sealed from the elements.

Lift bed or platform 30 is generally rectangular as demonstrated in FIGS. 1, 3 and 6. Platform 30 has a forward or first end 31 and rearward entry or second end 32. Platform 30 is moveably held in a substantial horizontal plane between lowered position AA and raised position BB, as shown in FIGS. 2 and 4. Platform 30 in the preferred embodiment is also rectangular and may also be described as a frame 30 constructed of a first end beam or member 31, a second end beam or member 32, a forward side beam or member 33 and an opposing side beam or member 34. Said members 31, 32, 33, and 34 are joined at their adjacent ends to form the rectangular lift platform 30. For purpose of this detailed description first end 31 is synonymous with first end beam or member 31 and rearward entry or second end 32 is synonymous with second end beam or member 32.

In the preferred embodiment members 31, 32, 33 and 34 are hollow along their length for weight purposes and, as shown below, containment of moving elements therein.

The lift platform 30, in the preferred embodiment includes boat skids 35 affixed by support members 36 attached to end members 31 and 32. The lifting power of the device is provided by a hydraulic cylinder assembly as most clearly demonstrated in FIGS. 2 and 4. FIG. 2 depicts a hydraulic cylinder assembly 50 to be operated in parallel with a second assembly 50 on the opposite side of the hoist assembly 10. FIG. 4 depicts the components of an assembly 50 which is utilized alone. Assembly 50 includes a hydraulic cylinder 51 which has a cylinder body 52 fixed within enclosure 20 with a closed end 53 aligned toward the first end 20*a* of the support enclosure member 20 and aligned lengthwise, substantially in horizontal parallel with such enclosure 20. Opposite the closed end 53 a piston rod 54 is extendable from the cylinder body 52, substantially horizontally toward the second end of enclosure support member 20. A yoke member 55 is affixed to outer end 56 of the piston rod 54, vertically centered and perpendicular to piston rod 54.

In the preferred embodiment an upper guide track 57*a* and lower guide track 57*b* are fixed horizontally within the support enclosure structure 20 in parallel with piston rod 54 from the hydraulic cylinder body 52 to a position 58 proximate the second end 20*b* of the support enclosure structure 20. Tracks 57*a* and 57*b* are located on opposite sides of piston rod 54 and are conformed to retain the yoke member 55 slidably between them with upper end 55*a* of yoke member 55 contacting track 57*a* and lower end 55*b* of yoke member 55 contacting lower track 57*b*. The conformation of tracks 57*a* and 57*b* to yoke 55 prevents rotational and vertical movement of the yoke 55 and piston rod 54, thus minimizing wear on cylinder body 52.

In the preferred embodiment of the invention tracks 57*a* and 57*b* are formed by provision of a "C-channel" fitting. Other possible applications include extruded ridges on back panel 25 and separate track elements separately attached to said back panel 25.

A first lift cable 60 is affixed to yoke 55 at its upper end 55*a*. Lift cable 60 extends substantially horizontally to and over a first pulley 61 fixed within support enclosure member 20 proximate its first end 20*a*. Cable 60 is directed over pulley 61 downward approximately 90° and continues to extend vertically downward through opening 23 until it reaches and is affixed to lift platform 30 at its first end 31. In a preferred embodiment this at a fixed point 65.

A second lift cable 62 is affixed to yoke 55 at its lower end 55*b*. Lift cable 62 extends substantially horizontally parallel to lift cable 60 until it reaches center pulley 63. Cable 60 is reversed approximately 180° over pulley 63 and further extends substantially horizontally to and over third pulley 64 fixed within support member 20 proximate its second end 20*b*. Cable 62 is directed over pulley 63 downward approximately 90° and continues to extend vertically downward through opening 24 until it reaches and is affixed to lift platform 30 at its second end 32, at fixed point 66.

As shown in FIG. 2, extension of piston rod 54 to move yoke 55 from position CC to position DD (distance CD)

moves lift platform 30 upward from position AA to position BB (distance AB). Distance AB is approximately equal to distance CD.

In the preferred embodiment of the invention stabilization of the horizontal inclination of the lift platform 30 when traversing between points AA and BB is maximized by the use of one or more leveling cables 70. Two leveling cables 70*a* and 70*b* are partially shown in FIG. 3 and FIG. 4. A complete leveling cable 70 assembly is shown in FIG. 5, as cable 70*a*.

Leveling cable 70*a* is affixed to the upper portion 16 of stanchion 12*c*. It extends generally vertically downward to and under a first platform pulley 71 affixed to and horizontally aligned on the first end member 31 of lift platform 30 approximately 90° laterally and further extends along the length of first end member 31 to and over a second platform pulley 72 approximately 90° vertically downward where it is affixed at a point 73 on the base frame 11 on or proximate to stanchion 12*a*.

In the preferred embodiment of the invention first end member 31 is hollow and the interior thereof provides an enclosure 74 which houses pulleys 71 and 72 and the traverse of leveling cable 70*a* between them.

In boat hoist 10 utilizing a single hydraulic cylinder 51 a second leveling cable using corresponding pulleys 71 and 72 is utilized with said cable affixed to the upper portion 16 of stanchion 12*d* traversing downward then along second end member 32 and downward to a corresponding point on the base frame 11 on or proximate to stanchion 12*b*.

In boat hoist applications where two hydraulic cylinders 51 are used on opposite sides of the hoist assembly 11, if leveling cables 70 are used, in the preferred embodiment the leveling cable 70 which corresponds with the second end 32 of the lift platform 30 would be initially affixed to the upper portion of stanchion 12*b*, extend downward and under pulley 72, along end member 32 and over pulley 71 and downward to a point 75 on base frame 11, on or proximate to stanchion 12*d*.

Figure 7:
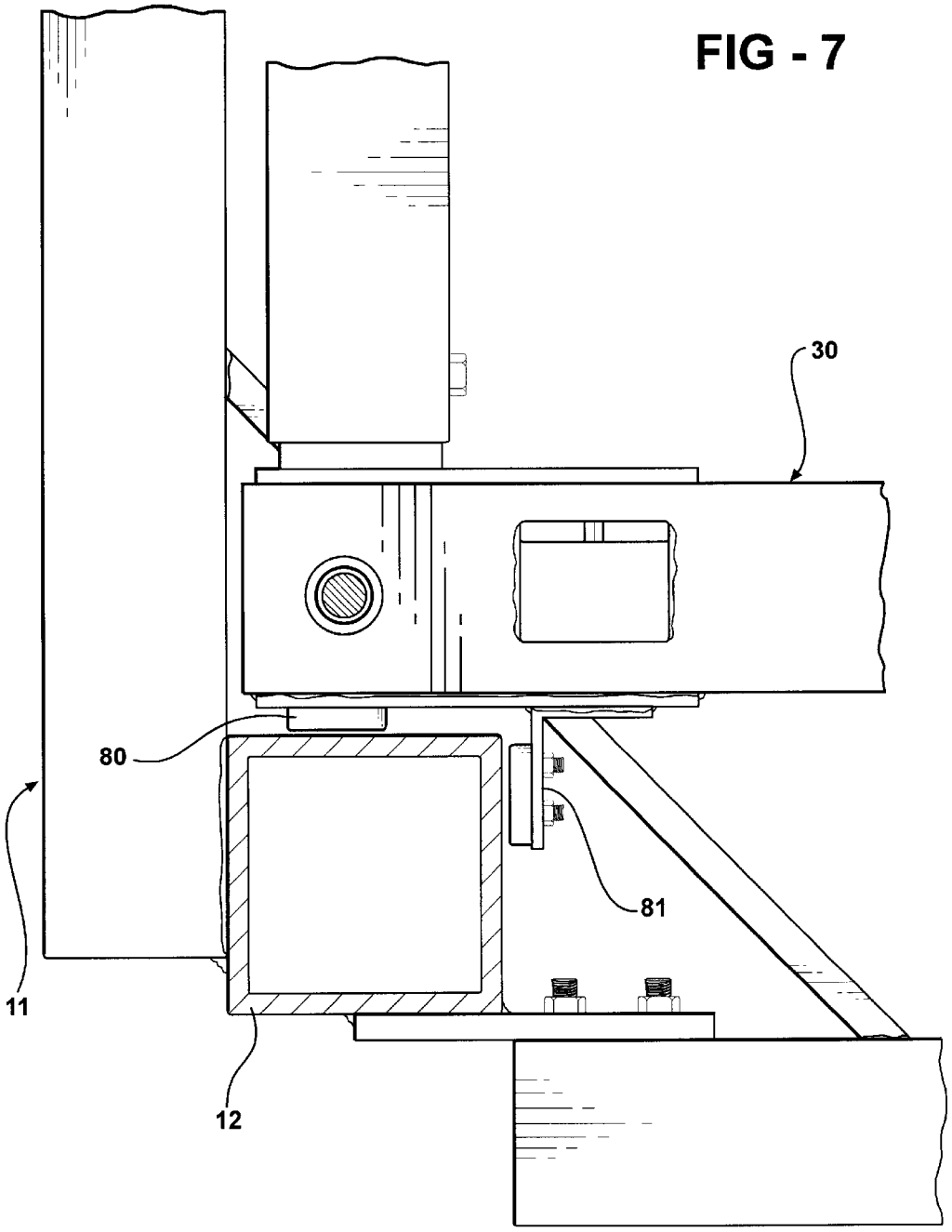
FIG. 7 is a cross-sectional view of a corner of a boat hoist showing a portion of the base, a corner stanchion, and configuration of a lift bed corner relative to the corner stanchion.

FIG. 7 shows a portion of a corner of base 11 including a cross section of a stanchion 12 and corresponding portion of lift platform 30 with alignment guide members 80 and 81 to maintain the position of platform 30 in relationship the base 11 and stanchions 12*a*, 12*b*, 12*c* and 12*d*.

A battery 90, which in the preferred embodiment is a 12 volt battery is included as a self contained power source for operation of the hydraulic cylinder 52. In the preferred embodiment of the invention, as shown in FIG. 6, a rigid solar panel 91 is provided, to regenerate the power source 90. An on/off switch mechanism 92 is provided to activate the horizontal cylinder. In the preferred embodiment the switch 92 is a radio frequency receiver, which may be activated by a remote sender unit.

Whereas, the preferred embodiment of the invention has been illustrated and described in detail, it will be apparent that various changes may be made in the disclosed embodiment without departing from the spirit of the invention.

What is claimed is:

1. A hydraulic lift device for an in-water boat hoist having a base frame, a purality of vertically extending stanchions, and an upwardly moveable lift platform, having a first end and a second end, said hydraulic lift device comprising:

a horizontally extending rigid support member having a first end and a second end, including:

a horizontally planar base panel;

a corresponding horizontally parallel planar top panel;

said planar base panel and planar top panel each having a corresponding forward edge and rearward edge and a corresponding first end edge and second end edge;

said base panel further defining a first aperture proximate its first end edge and a second aperture proximate its second end edge;

a vertical panel back extending between and connecting the rearward edges of the base panel and top panel between their respective first and second end edges, forming a unitary first end edge and a unitary second end edge; and a first end panel and a second end panel extending between and affixed to the first unitary edge and the second unitary edge, respectively;

a hydraulic cylinder including a cylinder body affixed horizontally within said support enclosure member, said cylinder body being closed proximate the support enclosure member's first end, and having a piston rod with an outer end, extendable from said cylinder body, horizontally, toward the support enclosure member's second end;

said hydraulic cylinder further comprising:

a vertical yoke member with an upper end and lower end, affixed vertically centered and perpendicular to the piston rod at its outer end;

a reverse directional cable transfer means located proximate to the cylinder body and affixed within the support enclosure member;

a first downward directional cable transfer means located proximate the first end of the support enclosure member and affixed therein;

a second downward directional cable transfer means located proximate the second end of the support enclosure member and affixed therein;

a first lift cable affixed to the upper end of the yoke member and extending substantially horizontally over the first downward directional cable transfer means substantially 90° vertically downward, through said first aperture, and affixed to the first end of the lift platform;

a second lift cable affixed to the lower end of the yoke initially extending substantially horizontally over the reverse directional cable transfer means and then substantially 180° horizontally over the second downward directional cable transfer means substantially 90° vertically downward through said second aperture and affixed to the second end of the lift platform;

a power source for operating the hydraulic cylinder; and a means of activating said hydraulic cylinder.

2. The device of claim 1, wherein, the reverse directional cable transfer means and the first and second downward directional cable transfer means are vertically mounted pulleys.

3. The device of claim 1, wherein the support enclosure member further comprises a front vertical panel member opposing the back panel member and contacting and removably affixed to the forward edges of the base panel and the top panel.

4. The device of claim 1, wherein the power source is a 12 volt battery supported by the base panel of the support enclosure member.

5. The device of claim 1, wherein the means of activating the hydraulic cylinder comprises an off/on switch.

6. The device of claim 1, wherein the means of activating the hydraulic cylinder comprises a radio frequency receiver unit located adjacent the cylinder body and a remote radio frequency sender unit.

7. The device of claim 1, wherein the device further comprises a self-contained means of replenishing the power source.

8. The device of claim 7, wherein the means of replenishing the power source further comprises a rigid solar panel attached to the power source.

9. The device of claim 1, wherein an upper guide track and a lower guide track are fixed horizontally within the support enclosure member in parallel with the extendable piston rod, said track guides extending from the hydraulic cylinder to a position proximate the second end of the support enclosure member with said upper and lower track guides being on opposite sides of the piston rod and conformed to retain the yoke member slidably between said upper and lower guide tracks.

10. The devise of claim 1, wherein the boat hoist base frame further comprises:

said base frame is horizontally rectangular with said plurality of vertically extending stanchions each having an upper and lower end extending vertically upward from positions proximate the corners of said horizontally rectangular frame;

said lift platform being moveably held in a substantially horizontal plane and guided between raised and lowered positions by said vertical stanchions, and having a forward side member, opposing side member, first end member and second end member; and said support enclosure member being affixed between the upper ends of the stanchions extending vertically upward from positions proximate the corners adjacent to the forward side member of the lift platform.

11. The device of claim 10, further comprising:

a third directional cable transfer means affixed to the first end member of the lift platform proximate the opposing side member and a fourth directional cable transfer means affixed to said first end member proximate the forward side member;

a leveling cable having a first end affixed to the upper end of the stanchion most proximate the opposing side member and first end member of the lift bed, said cable extending substantially vertically downward and under the third directional cable transfer means substantially 90° horizontally along said first end member and over the fourth directional cable transfer means substantially 90° vertically downward to a second end affixed to the base frame proximate the stanchion proximate the forward side member and the first end member.

12. The device of claim 11, wherein the device additionally comprises a fifth directional cable transfer means affixed to the second end member of the lift platform proximate the opposing side member and a sixth directional cable transfer means affixed to said second end member proximate the forward side member; and a second leveling cable having a first end affixed to the upper end of the stanchion most proximate the opposing side member and second end member of the lift bed; said cable extending substantially vertically downward and under the fifth directional cable transfer means substantially 90° horizontally along said second end member and over the sixth directional cable transfer means substantially 90° vertically downward to a second end affixed to the base frame proximate the stanchion proximate the forward side member and the second end member.

13. The device of claim 12, wherein said directional cable transfer means are pulleys horizontally aligned along the respective first and second end members.

14. The device of claim 12, wherein the first and second end members each define a hollow lengthwise enclosure, enclosing, respectively, the third and fourth, and fifth and sixth, directional cable transfer means and the extension between them of the respective leveling cable and second leveling cable.

15. The device of claim 12, wherein the leveling cable and second leveling cable are installed under static tension.

16. The device of claim 10, further comprising:

a second hydraulic lift device and respective support enclosure member in parallel affixed between the upper ends of the stanchions extending vertically upward from positions proximate the corners adjacent to the opposing side member of the lift platform.

17. The device of claim 16, further comprising:

a third directional cable transfer means affixed to the first end member of the lift platform proximate the opposing side member and a fourth directional cable transfer means affixed to said first end member proximate the forward side member; a leveling cable having a first end affixed to the upper end of the stanchion most proximate the opposing side member and first end member of the lift bed, said cable extending substantially vertically downward and under the third directional cable transfer means substantially 90° horizontally along said first end member and over the fourth directional cable transfer means substantially 90° vertically downward to a second end affixed to the base frame proximate the stanchion proximate the forward side member and the first end member; and a fifth directional cable transfer means affixed to the second end member of the lift platform proximate the upward side member and a sixth directional cable transfer means affixed to said second end member proximate the forward side member; and a second leveling cable having a first end affixed to the upper end of the stanchion most proximate the forward side member and second end member of the lift bed; said cable extending substantially vertically downward and under the sixth directional cable transfer means substantially 90° horizontally along said second end member and over the fifth directional cable transfer means substantially 90° vertically downward to a second end affixed to the base frame proximate the stanchion proximate the opposing side member and the second end member.

18. The device of claim 16, wherein both hydraulic lift devices utilize a common power source and common means of activating the respective hydraulic cylinders.

* * * * *